United States Patent [19]

Gould et al.

[11] 4,117,447

[45] Sep. 26, 1978

[54] BOUYANT ELECTRODE WITH ANTI-BIRDNESTING DEVICE

[75] Inventors: Paul F. Gould, Panama City; James O. Pate, West Bay, both of Fla.

[73] Assignee: The United States of America as represented by the Secretary of the Navy, Washington, D.C.

[21] Appl. No.: 828,714

[22] Filed: Aug. 29, 1977

[51] Int. Cl.[2] ..... B63B 21/56; H01B 7/12

[52] U.S. Cl. ..... 340/4 E; 114/253; 174/69; 174/101.5; 340/3 T

[58] Field of Search ..... 340/3 T, 4 E; 114/244, 114/253, 254; 174/99 E, 101.5, 69, 21 C, 21 CA

[56] References Cited

U.S. PATENT DOCUMENTS 3,940,732 2/1976 Hudson et al. ..... 340/4 E

*Primary Examiner*—Richard A. Farley

*Attorney, Agent, or Firm*—Richard S. Sciascia; Harvey A. David

[57] ABSTRACT

A towable cable type electrode has a bouyant core covered by a layer of helically laid wire strands and is characterized by a slide member near the aft end of the electrode to which the aft ends of the wire strands are secured. The slide member is constrained by guides to axial movement along the core so as to accommodate excess length in the wire strands that works its way aft along the electrode during use.

10 Claims, 3 Drawing Figures

BOUYANT ELECTRODE WITH ANTI-BIRDNESTING DEVICE

BACKGROUND OF THE INVENTION

This invention relates to towed electrodes of the cable type such as are used for sweeping of magnetic influcence marine mines, and more particularly to an improved electrode construction therefor.

U.S. Pat. No. 3,940,732, issued to J. A. Hudson and M. J. Yelverton and assigned to the assignee hereof, describes a bouyant electrode of a cable type that is towed-along its axial length, by a helicopter for example, at substantial speeds through sea water. The electrode is energized to produce electrical currents in the sea water. Magnetic disturbances resulting from the electrical currents and the forward motion of the electrode are effective in sweeping magnetic influence mines. The electrode of that patent comprises a core of central strength member in the form of a synthetic filament rope, a cylindrical bouyant sleeve of a closed cell plastic foam material and an outer conductive layer formed of helically wound strands of aluminum wire. The aluminum wire strands are tightly bound with an aluminum wire serving in the forward portion of the electrode, and the forward end of the electrode is provided with a conductive metal lug or connector that is swaged or otherwise fixed to the strength member and provides for electrical connection to the serving and to the helical wires of the electrode. At the aft end of the electrode, the helical wires are bound to the bouyant sleeve by one or more metal bands, preferably of the screw tightened variety.

While the aforedescribed prior art electrode has many advantages, it has been found that it suffers one disadvantage in that excess aluminum wire is unavoidably distributed along the length of the electrode during the helical winding thereof and, during use, the excess tends to work its way along the electrode and accumulates at the aft end. The accumulation presents itself as a balooning out or enlargement in the wire layer resembling a bird nest just ahead of the band clamping the wire ends. In view of this, it has been the practice to precondition each electrode by towing it for a period of time, then removing the band clamp, manually cutting off the excess wire of each strand, and reclamping. Even with such preconditioning, there remains a tendency for the problem to repeat itself. If the bird nest is not removed it results in shortened electrode life, tow drag is increased, and handling is made more difficult.

SUMMARY OF THE INVENTION

With the foregoing in mind, it is a principal object of this invention to provide an improved bouyant electrode of the cable type having a layer of helically wound wire strands.

Another object of the invention is to provide an electrode of the foregoing type that will not develop an accumulation of wire or birds nest.

Still another object is the provision of an improved helically wire wound bouyant electrode for towing at sea and which does not require preconditioning towing and removal of excess wire.

As another object the invention aims to provide an electrode cable that is reliable in performance, easy to maintain, and simple to manufacture.

Yet another object is the provision of a towable electrode cable that presents less drag, has longer active life, and is easier to handle than the prior art electrodes of the type concerned.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
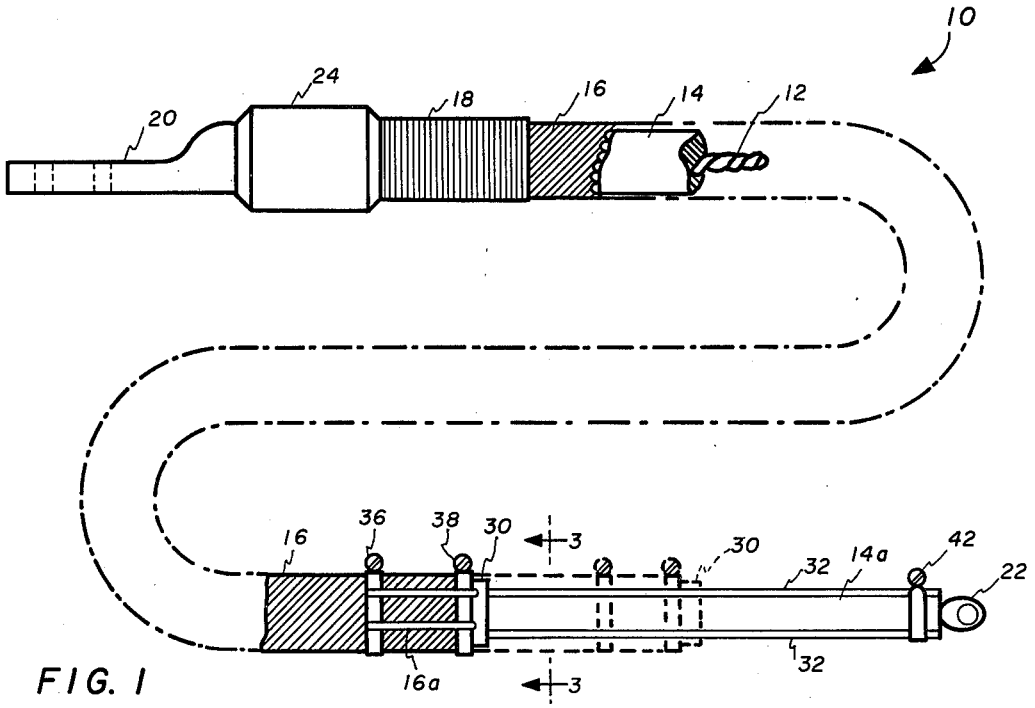
FIG. 1 is an elevational view of an electrode embodying the invention.

Referring to FIG. 1, a flexible, bouyant, cable type of electrode is indicated generally at 10 and comprises a central strength member 12, a cylindrical sleeve 14 of bouyant material surrounding the strength member, a layer 16 of helically laid aluminum wire strands, a wire serving 18, and a forward end connector 20.

Additionally, the electrode 10 conveniently comprises an aft end connector eye loop 22 and a molded synthetic rubber collar 24. The general construction of the electrode 10 is similar to that of the electrode described in the mentioned U.S. Pat. No. 3,940,732, to which reference may be had for details relating to the manner in which the parts thus far named are made and assembled.

Figure 2:
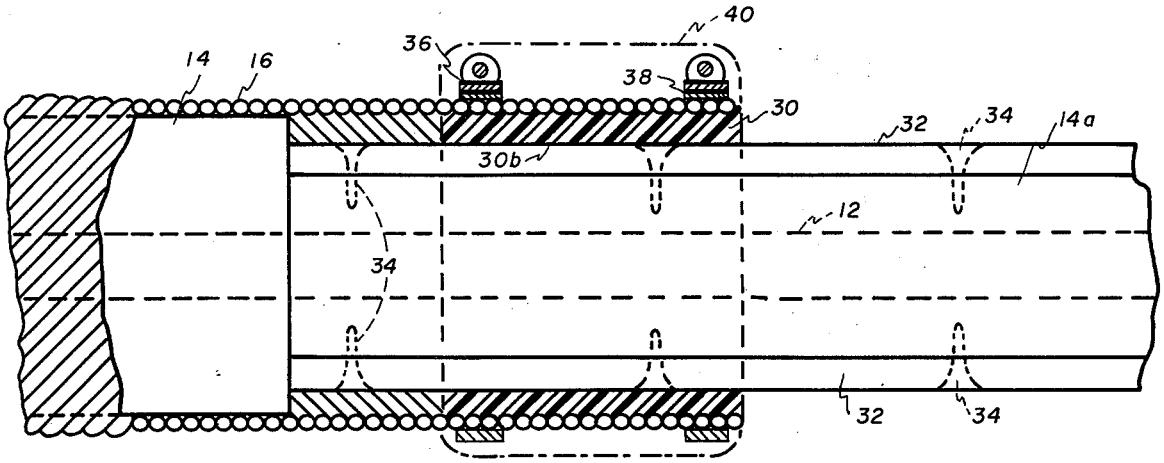
FIG. 2 is an enlarged fragmentary view, partly in section, of a portion of the electrode of FIG. 1.
Figure 3:
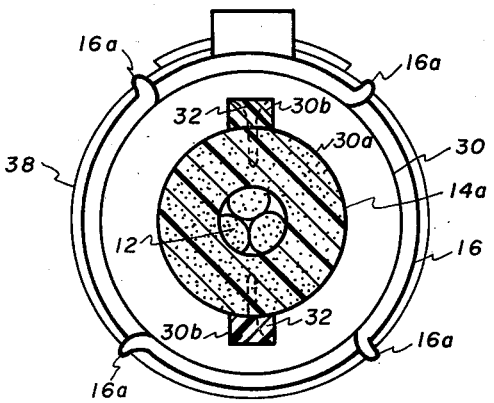
FIG. 3 is an enlarged sectional view of the cable taken substantially along line 3—3 of FIG. 1.

The electrode 10 of this invention differs from the prior art in the manner in which the layer 16 of helically laid aluminum wire strands are secured at the aft end of the electrode. In accordance with the present invention, provision is made for preventing the formation of a bird nest like enlargement of the layer 16 due to accumulation of excess length in the wire strands working back to the aft end of the electrode during use. To this end, referring now additionally to FIGS. 2 and 3, the bouyant cylindrical sleeve 14 has a reduced diameter portion **14*a* extending for a predetermined length ahead of the aft end connector 22. A cylindrical slide member 30, formed of nylon or other durable rigid plastic material having a low coefficient of sliding friction, has a central bore 30*a* and is slideably mounted on the reduced portion 14*a*** of the bouyant sleeve.

The slide member 30 is prevented from rotating on the reduced portion **14*a*, and limited to axial aliding motion therealong, by a pair of longitudinal keys or guide strips 32 that are fastened along opposite sides of the reduced portion as by screws 34. The slide member 30 has guideways or grooves 30*b* formed therein for cooperation with the ribs defined by the guide strips 32**.

The layer 16 of helically laid wire strands extends over the slide member 30 and is clamped tightly thereto by a pair of metal bands or clamps 36,38, preferably of the screw tightened type. In this preferred embodiment, the end portions of the four wire strands **16*a* of the layer 16 are bent forward over the rear clamp 38 and under the forward clamp 36. A covering 40, shown in phantom in FIG. 2, of waterproof plastic tape, moulded rubber, or the like is formed around the clamps 36,38 and the wire layer 16 over the slide member 30 to protect these elements against damage from rough handling, snagging on other objects, or the like. A band or clamp 42 is provided near the end of the reduced portion 14a as a mechanical stop or limit to sliding travel of the slide member 30**.

When the electrode is new, the slide member 30 is disposed close the shoulder of the bouyant sleeve 14. As the electrode is used and excess wire in the strands of layer 16 works its way aft along the electrode, the slide member 30 moves from its full line position of FIG. 1 toward the dotted line position thereof of that figure. Because of the freedom of the slide member 30 to move axially, while being prevented from rotation by the guide strips 32, an accumulation of excess wire in the strands of layer 16 is readily taken up by movement of the slide member along the reduced portion 14a toward the aft end of the electrode 10. Accordingly, the layer 16 is saved from the distortions that have produced the bird nest effect in prior art electrodes. Concomittantly, the electrode 10 is characterized by less drag in use, longer effective life, and considerable savings in maintenance effort.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A flexible electrode adapted to be towed along its long axis and having forward and aft ends, said electrode including a strength member, a bouyant sleeve surrounding said strength member, and a layer of helically laid wire strands covering said sleeve, said electrode being characterized by the improvement comprising:

a slide member, mounted adjacent said aft end for axial movement relative to said bouyant sleeve;

said wire strands having their forward ends fixed relative to said bouyant sleeve and their aft ends fixed to said slide member, whereby excess length in said wire strands that works back along said electrode during use is accommodated by axial movement of said slide member.

2. A flexible electrode as defined in claim 1, and wherein:

said bouyant sleeve comprises a larger diameter first portion supporting said layer and having a reduced diameter second portion adjacent the aft end of said electrode; and said slide member being substantially cylindrical and having an outside diameter substantially equal to that of said larger diameter first portion of said bouyant sleeve.

3. A flexible electrode as defined in claim 2, and wherein:

said slide member has an axial bore slideably receiving said smaller diameter second portion of said bouyant sleeve.

4. A flexible electrode as defined in claim 3, and further comprising:

guide means, operably interconnecting said slide member and said second portion of said bouyant sleeve, for constraining said slide member to axial sliding movement on said reduced diameter second portion.

5. A flexible electrode as defined in claim 4, and wherein said guide means comprises:

rib and groove means.

6. A flexible electrode as defined in claim 4, and further comprising:

clamp means surrounding said layer and binding said wire strands to said slide member.

7. A flexible electrode as defined in claim 6, and further comprising:

stop means, fixed to the aft end of said reduced diameter second portion for limiting said axial movement of said slide member.

8. A flexible electrode as defined in claim 7, and wherein said clamp means comprises a pair of axially spaced clamping bands.

9. A flexible electrode as defined in claim 8, and wherein:

said wire strands pass under said axially spaced clamping bands and are bent forward over the rearmost of said pair.

10. A flexible electrode as defined in claim 8, and further comprising:

a protective covering disposed around said clamping bands, said slide member, and the portions of said wire strands clamped thereto.

* * * * *